US010941575B2

(12) United States Patent
Raine

(10) Patent No.: US 10,941,575 B2
(45) Date of Patent: Mar. 9, 2021

(54) ADAPTABLE NOSING

(71) Applicant: STAIRRODS (UK) LTD, Blackhill (GB)

(72) Inventor: John Raine, Blackhill (GB)

( * ) Notice: Subject to any disclaimer, the term of this patent is extended or adjusted under 35 U.S.C. 154(b) by 0 days.

(21) Appl. No.: 16/041,451

(22) Filed: Jul. 20, 2018

(65) Prior Publication Data

US 2019/0024379 A1 Jan. 24, 2019

(30) Foreign Application Priority Data

Jul. 20, 2017 (GB) ..... 1711679

(51) Int. Cl.
*E04F 11/16* (2006.01)

(52) U.S. Cl.
CPC ..... *E04F 11/166* (2013.01)

(58) Field of Classification Search
CPC ..... E04F 11/166
USPC ..... 52/179
See application file for complete search history.

(56) References Cited

U.S. PATENT DOCUMENTS 1,611,211 A * 12/1926 Loehr ..... E04F 11/163 16/16
1,743,982 A * 1/1930 Scott ..... E04F 11/163 280/169
1,771,405 A * 7/1930 Felsenthal ..... E04F 11/16 52/179
3,895,981 A * 7/1975 Tesch ..... A47G 27/06 156/256
6,047,506 A * 4/2000 Kemper ..... E04F 11/166 52/179
6,606,827 B1 * 8/2003 Hoffmann ..... G09F 13/22 362/146
2006/0150539 A1 * 7/2006 Vanhastel ..... E04F 11/163 52/179
2011/0162302 A1 * 7/2011 Barrett ..... E04F 11/163 52/179
2011/0283636 A1 * 11/2011 Vanhastel ..... E04F 11/175 52/179
2012/0186171 A1 * 7/2012 Sondermann ..... E04F 11/166 52/179
2012/0297705 A1 * 11/2012 Kay ..... E04F 11/166 52/179

(Continued)

FOREIGN PATENT DOCUMENTS

DE 29518994 U1 * 5/1996 ..... E04F 11/166

OTHER PUBLICATIONS

Translation of attached DE 29518994 (Year: 1996).*

*Primary Examiner* — Basil S Katcheves
(74) *Attorney, Agent, or Firm* — Law Office of Jeff Williams PLLC; J. Oliver Williams

(57) ABSTRACT

A stair nosing for use on stairs with composite tread composed of a stair tread and a supplementary tread of e.g. LVT, which is an elongate profile member having a back facing for abutting a front surface of the composite tread, an opposing front facing and a profile tread surface and a first fixing to fix to the nose surface of the stair tread is able be fitted securely to a stair with a bull nose without the need to adapt or cut the bull nose. The stair nosing is capable of bending in order to fit to curved stairs thereby enabling supplementary tread or covering to be applied to a curved stair without squaring off or reforming curved stairs.

16 Claims, 6 Drawing Sheets

(56) References Cited

U.S. PATENT DOCUMENTS

| | | | | |
|---|---|---|---|---|
| 2014/0013681 | A1* | 1/2014 | Disch | E04F 11/16 52/179 |
| 2014/0174005 | A1* | 6/2014 | Richard | E04F 11/175 52/179 |
| 2016/0376793 | A1* | 12/2016 | Halischuk | E04F 11/166 52/179 |

* cited by examiner

ADAPTABLE NOSING

CLAIM OF PRIORITY

This application claims the benefit of GB Nonprovisional Application No. 1711679.9, filed 20 Jul. 2017. The information contained therein is hereby incorporated by reference.

BACKGROUND

1. Field of the Invention

This invention pertains generally to the field of stair fittings and more particularly to nosings for stairs, to a method of manufacturing and to a method of fitting the nosing to a stair fitting and to a method of re-covering a stair with a laminate or vinyl covering.

2. Description of Related Art

Stair nosings are commonly used to provide improved grip on a stairway and to provide an edging on laminate or vinyl stair coverings between a tread and a riser.

When fitting a new stair covering, such as luxury vinyl (e.g. LVT), which is required to be adhered to a floor, vinyl is usually fixed to a base, typically of plywood (e.g. a 6 mm plywood base), in order to get good adhesion and provide a smooth underlay. A difficulty in fitting to stairs is, typically, stairs have a bull nose, in which the tread overhangs the riser to allow a suitable tread width for one's feet. This makes it difficult when fitting rigid members such as plywood basis for vinyl coatings. Usually, a joiner will be employed to cut off or square off the bull nose. This presents a difficulty if the householder ever decides to lift the vinyl and re-fit carpet. Alternatively, for a straight stair, the problem is often addressed by boxing out the riser, which gives the difficulty of reducing the tread width and also giving a rather clean, commercial appearance. Secondly, many stairwells have a bottom step or two that have a curved, asymmetrical shape. This also presents a difficulty when fitting a coating such as a vinyl or LVT since the joiner will have to square off the bottom step, very much changing the aesthetics of the stairwell.

A squared-off stairwell having squared off or removed bull nose and, where present, a squared of bottom step or two may then be fitted with a ply board (carrying the vinyl) and with a nosing, which is typically of aluminium or plastic and usually an L-shaped profile. The nosing may be configured to fit partially beneath the tread ply that is applied so only part of the nosing is visible.

There is a need for an improved, quality, nosing that enables a quality vinyl covering to be retrofitted to stairwells without the need to reshape the bull nose or bottom stair.

The present inventor has developed an improved nosing to facilitate the fitting of a stair covering such as a luxury vinyl (e.g. LVT).

There is a need for improvements in stair nosings.

It is an object of this invention to provide a stair nosing that can be used on a stair having a bull nose without the need to joinery adjustment or squaring off.

It is an object of this invention to provide a stair nosing that can be used on a curved step without need to square off the stair.

It is an object of this invention to provide a method of fitting a vinyl coating on a stair.

SUMMARY OF THE INVENTION

In accordance with a first aspect of the invention, there is provided a stair nosing comprising an elongate profile member having a back facing configured for abutting a nose of a stair tread, a front facing generally opposed to the back facing and a profile tread surface, which elongate profile member comprises a first fixing arrangement for facilitating fixing to a nose surface of the nose of the stair tread; and optionally a second fixing arrangement disposed toward the profile tread surface relative to the first fixing arrangement.

In a second aspect of the invention, there is provided a method of installing a supplementary tread or covering on a stair tread having a bull nose to form a composite tread, the method comprising affixing the supplementary tread or covering on to the stair tread to define a composite tread front surface and affixing to the front surface of the composite tread a stair nosing as defined above by fixing a first fixing arrangement to a nose surface of a nose of the stair tread and optionally a second fixing arrangement to the front surface of the composite tread at a position disposed toward the profile tread surface relative to the first fixing arrangement.

In a third aspect of the invention, there is provided a stair case comprising a plurality of composite stair treads separated by risers, the composite stair treads comprising an original stair tread having a nose and affixed thereon a supplementary tread extending from riser to nose to define a composite front surface with the nose and affixed to the composite front surface a stair nosing as defined above.

In a fourth aspect of the invention, there is provided a stair nosing comprising an elongate profile member having a back facing, a front facing generally opposed to the back facing, a recess disposed in the front facing and defining a recessed facing and a profile tread surface, which elongate profile member comprises a first fixing arrangement comprising a series of apertures for fixings disposed along the length of the elongate profile member and optionally a second fixing arrangement comprising a plurality of projecting members extending from the back facing of the elongate profile member and disposed along its length, the projecting members being integral with the elongate profile member and disposed toward the profile tread surface relative to the first fixing arrangement.

In a fifth aspect of the invention, there is provided a stair nosing comprising an elongate profile member that is absent lateral axis stiffening profile sections.

The stair nosing of the invention enables a nosing to be fitted to a stair having a supplementary tread or covering (such as luxury vinyl tiles or LVT) which stair has a bull nose, to be fitted securely without the need to adapt or cut the bull nose. The stair nosing of preferred embodiments is capable of bending in order to fit to curved stairs thereby enabling supplementary tread or covering to be applied to a curved stair without squaring off or reforming curved stairs.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
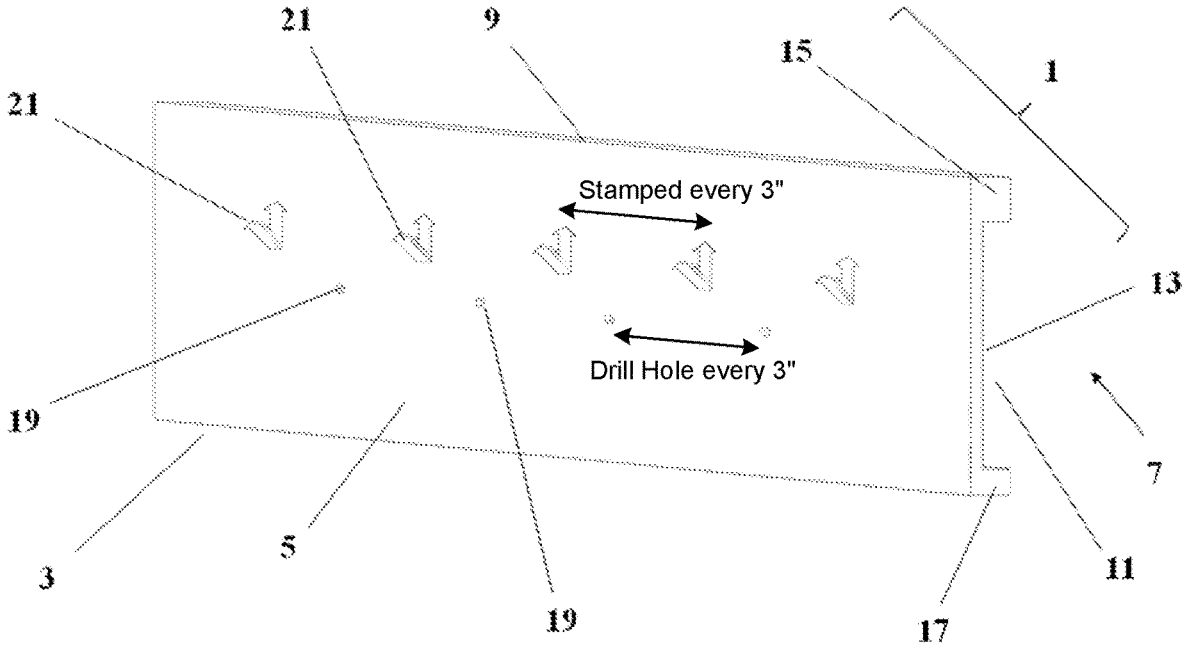
FIG. 1 is a back perspective view of a stair nosing according to one embodiment of the present invention.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The invention provides for an improved stair nosing which is suitable for use on stairs with a supplementary tread or covering, such as LVT, or to which a supplementary tread or covering is to be applied.

A stair comprises a tread and disposed vertically between each tread a riser, the tread typically overhanging the riser. The nose of the tread, provided at the front face of the tread, is commonly a bull nose. It is commonplace for stairs to be revised and adapted to provide a supplementary tread or covering which together with the stair tread can be said to provide a composite tread. The composite tread will typically comprise the stair tread and fitted to the upper surface thereof a supplementary tread or coating. The supplementary tread may comprise a coating material such as an LVT coating or similar and support element such as a plywood or other rigid sheet. The composite tread may be said to define a front surface comprising a nose of the stair tread and a front edge of a supplementary tread or covering.

The stair nosing of the present invention comprises an elongate profile having a back facing configured for abutting a nose of a stair tread and more particularly a front surface of a composite tread. The elongate profile has a front facing generally opposed to the back facing and a profile tread surface, which is typically at an upper surface of the elongate profile when in situ affixed to a stair.

The elongate profile preferably has a longitudinal axis, which is an axis in the direction of the largest dimension (the elongate direction). A lateral axis is an axis perpendicular to the longitudinal axis and in the plane (or parallel to the plane) of the back facing (and can be said to extend across the width of the elongate profile member). A transverse axis may be said to be normal to the longitudinal and lateral axes (and extend through the plane of the back facing).

Preferably, the stair nosing is provided with a recess formed in the front facing of the elongate profile member, which recess extends along the length of the elongate profile member and which recess defines a recessed facing. The recess may be used to accommodate a decorative element, such as a strip of the same material used as or with the supplementary tread or a material or device for displaying a pattern or message (such as information or advertising).

The elongate profile member comprises a first fixing arrangement and, preferably, a second fixing arrangement.

The first fixing arrangement is for facilitating fixing of the elongate profile member to a nose surface (typically a bull nose surface) and may comprise any suitable conventional fixing suitable for this purpose and typically or preferably comprises a series of apertures disposed at separations (preferably evenly distributed) along the length of the elongate profile member and extending from the front facing (or, preferably, where present, from the recessed facing formed in the front facing) to the back facing. Each aperture is preferably configured to receive a suitably sized nail or screw and preferably allows the nail or screw head to be flush with the front facing (or, preferably, where present, flush with the recessed facing) when in place. Preferably, the apertures are disposed at separations of from 3 to 10 cm along the length of the elongate profile member, more preferably at least 5 cm (e.g. 6 to 8 cm) and most preferably every 7.5 cm. Preferably, the apertures each have a diameter of from 3 to 5 mm. The apertures may be formed by any suitable method such as drilling, stamping or punching.

The optional second fixing arrangement is disposed toward the profile tread surface relative to the first fixing arrangement. In situ the second fixing arrangement is disposed above the first fixing arrangement and closer to the upper surface of the composite tread (and to the profile tread surface). The second fixing arrangement is for facilitating fixing to the front surface of the composite tread. Optionally, the second fixing arrangement may comprise simply the use of glue and preferably comprises an arrangement to facilitate engagement between glue at a front surface of a stair tread (e.g. into a composite surface recess which is formed between a bull nose and a supplementary tread) and a back facing of the elongate profile member. Such an arrangement may comprise an arrangement of ribs on the back facing, a roughening of the surface along a portion of the back facing or a plurality of small protrusions. Preferably, the second fixing arrangement comprises one or more projecting members projecting from the back facing of the elongate profile member. The projecting members are configured, in use, to extend into a composite surface recess which is formed between a bull nose and a supplementary tread (when a flat element of a supplementary tread is disposed on a stair tread with a bull nose). The projecting members may project normal to the back facing or may be disposed at an angle to the normal, e.g. of up to 60°. The projecting members may be disposed at a shallow angle to the normal of, e.g. up to 30° more preferably up to 20° or, still more preferably up to 15° and most preferably up to 10°. Alternatively, the projecting members may be disposed at a greater angle to the normal, e.g. in the range 20° to 60°, preferably 25° to 50° and most preferably 30° to 45°. When disposed at an angle to the normal, the projecting members may be disposed at an angle along a vertical normal plane (i.e. a vertical plane extending perpendicularly from the plane of the back facing) or a horizontal normal plane or a normal plane intermediate to the vertical and horizontal. Where a plurality of such projections are provided, each projection may project in an identical configuration, or one or more or all of the projections may be provided in different configurations from others (e.g. so that the projections may extend at a variety of angles to the normal to the back facing). Preferably, the projecting members are disposed at an angle of 30° to 45° to the normal to the back facing and preferably disposed at an angle along a respective vertical normal plane. Preferably, the projecting member projects (or members project) from the back facing to an extent up to 10 mm, preferably from 2 to 8 mm and more preferably from 3 to 5 mm. Preferably, the length of the projecting members is from 5 to 15 mm and more preferably 5 to 10 mm (e.g. 6 to 8 mm) and most preferably about 7 mm, although the perpendicular extent of projection from the back facing will be less if they are disposed at an angle.

The projecting member(s) may be secured in place in the composite surface recess by use of an adhesive or filler, preferably a glue or adhesive resin.

The projecting member or members may be integral with or formed integrally with the elongate profile member or they may be separate components.

In one embodiment, a single projecting member is provided which comprises a single projecting profile member that extends the length of the elongate profile member. This may fit into an elongate composite surface recess in a stair with a composite tread and be secured there by glue or adhesive resin. Preferably, however, to improve the flexibility of the elongate profile member and of the nosing, the projecting member is discontinuous along the length of the elongate profile thereby preferably providing a plurality of discrete projecting members are provided.

In a second embodiment, the projecting member is discontinuous along the length of the elongate profile but is integral with the elongate profile member. This may be achieved, for example, by providing a single, continuous projecting member and periodically cutting and removing sections of the projecting member to make it discontinuous. Alternatively and preferably, a plurality of discrete projecting members are provided along the length of the elongate profile member by stamping a shape of a projecting member outward from the elongate profile member, e.g. by providing a stamp defining 3 sides of a projecting member and causing the stamped projecting members to bend outward to project from the back facing. Thus a corresponding aperture, the shape of the projecting member, will be formed in the elongate projecting member between the back facing and front facing or recessed facing.

In a third embodiment, a plurality of discrete projecting members are provided which are optionally not integral or not integrally formed with the elongate profile member. According to this embodiment, projecting members may be attached to or engage with the elongate profile member to form a nosing of one embodiment of the present invention. The projecting members may be attached or engaged by fitting into profiled slots on or in the back facing of the elongate profile member and retained therein by base flanges formed on the projecting members or may extend through apertures formed in the elongate profile member between the back facing and the front facing (or recessed facing) and retained in place by base flanges.

Preferably, where a plurality of projecting members are provided, they are provided separated from each adjacent profile members along the length of the elongate profile member by varied or consistent distances and preferably are disposed in an amount of at least one projecting member per 20 cm of elongate profile member length, preferably at least one projecting member per 10 cm and more preferably at least one projecting member per 5 cm of length. Ideally, at least one projecting member is provided every 7.5 cm.

One or more projecting members of the second fixing arrangement according to one embodiment, which are disposed along the length of the elongate profile member, preferably extend from a point closer to a profile tread surface (or further up) than the apertures of the first fixing arrangement by an amount of at least 3 mm and preferably no more than 15 mm, more preferably no more than 10 mm, still more preferably from 4 to 6 mm.

The projecting members of the optional second fixing arrangement according to one embodiment may be vertically aligned with the apertures of the first fixing arrangement or may (preferably) be offset or staggered Preferably, where a recess is formed in the front facing of the elongate profile member, the first and second fixing arrangements in a preferred embodiment are centered about the mid-point of the recess.

Preferably, projecting members are provided with one or more retention members to inhibit removal once set in situ in cured resin or similar. The retention members may be lateral or reverse barbs extending from the projection and/or the retention member may be incorporated into the projection member whereby the projection member is shaped like a hook, a double hook, an arrow or other effective or barbed shape. In the preferred embodiment, it is an arrow shape.

As indicated above, it is particularly preferred that the nosing (and the elongate profile member) is provided with a recess that extends along a length of the front facing of the elongate profile member. Typically, the recess will extend the full length of the elongate profile member. The recess typically accommodates an inset element, which may be any suitable inset element. The recess may be used typically to receive a decorative element to match, complement or contrast a material used for the supplementary tread. Alternatively, it may be used for information, messages or advertising. Optionally, the recess may receive an element to provide lighting, such as a luminescent strip, LED or other organic or polymer-based lighting material. Optionally, the recess may receive a digital message element for displaying variable digital information. Preferably, the recess receives a decorative element.

An inset element or decorative element may be secured in place within the recess by any suitable means and typically and preferably is secured by an adhesive resin.

The recess formed in the front facing and extending along the length of the elongate profile member defines a recessed facing, being a front facing within the recess.

The recess formed in the front facing, according to this embodiment, defines upper and lower forward projections that distinguish the front facing from the recessed facing. An upper forward projection typically has or defines at its upper surface a profile tread surface. Preferably, the upper forward projection has a thickness (from the recess to the profile tread surface) of 3 to 10 mm, preferably 4 to 6 mm. Preferably, the lower forward projection has a thickness of 1.5 to 10 mm, preferably 2 to 10 mm, more preferably 3 to 5 mm, e.g. up to 4 mm.

The recess may be defined as having a depth (front to back) suitable for receiving a desired thickness of inset element (e.g. decorative element). Generally, the recess has a depth in the range from 1 to 10 mm, more preferably 2 to 8 mm. Optionally, the recess may have a depth to accommodate an inset element having a thickness of 3 mm or 4 mm or 5 mm or even 7 mm. Preferably, the recess has a depth of from 2.5 to 5.5 mm to accommodate an inset element of a thickness of 3 mm or 4 mm or 5 mm.

Preferably, the upper and lower forward projections have a forward extent of from 2 to 8 mm from the recessed facing and in any case a distance correspond with the depth of the recess.

Preferably the width of the recess (from top to bottom, that is extending from the upper and lower forward projections) may be any suitable width to accommodate the desired width of inset element (or decorative element). Preferably, the width of the recess is up to 70 mm, more preferably up to 50 mm, still more preferably up to 40 mm, ideally at least 15 mm. Optionally, the width of the recess is from 30 to 45 mm or is from 20 to 35 mm, more preferably 25 to 33 mm.

As indicated above, the inset elements are preferably secured in place with an adhesive resin. Optionally, lateral retention members (continuous profile lateral retention members) may be provided that extend from the upper and/or lower projections (at the border of the front facing and the recess) into the recess. These may serve to physically retain the inset elements in place within the recess. The lateral retention members may extend into the recess by up to 3 mm, or up to 2 mm or up to 1 mm. More preferably, however, the elongate profile members are absent any lateral retention members extending from the upper and lower projections into the recess. Such lateral retention members serve to define a U-section, which introduce rigidity. In a preferred embodiment of the present invention, the nosing is configured to facilitate bending to affix to a curved stair and so is preferably absent upwardly or downwardly orientated U-sections.

Preferably the first fixing arrangement, and preferable second fixing arrangement, are provided within the bounds of the recess in the front facing.

Preferably, the profile thickness between the back facing and the recess facing (i.e. within the bounds of the recess) is in the range 1 to 3 mm, such as up to 2.5 mm or up to 2 mm, more preferably 1.25 mm to 1.75 mm and optionally at least 1.5 mm.

Preferably, the width of the elongate profile is up to 80 mm, more preferably up to 75 mm, more preferably up to 70 mm, still more preferably in the range 20 to 50 mm, e.g. from 35 to 50 mm and ideally 30 to 40 mm.

To enable the nosing to be capable of bending, e.g. to affix to curved stairs, the maximum thickness of the profile (from front to back) is preferably from 3 to 11 mm, and more preferably up to 8 mm and optionally up to 6 mm and in one embodiment up to 5 mm.

In one embodiment, the elongate profile member comprises a back-projecting tread profile member, for example to extend over the supplementary tread of the composite tread. This may, for example, extend up to 5 mm from the back facing, or up to 2 mm from the back facing. Preferably, the elongate profile member is absent a back-projecting tread profile member. A back facing projecting tread profile member of any great extent (e.g. over 5 mm) is likely to introduce greater rigidity into a nosing and restrict flexibility and inhibit its use on curved stairs. It is preferred that back facing projecting tread profile members are no more than 5 mm, preferably no more than 2 mm. Still more preferably, there is no back projecting profile tread member in the present embodiment.

In a particularly preferred embodiment, there are no continuous profile projections extending from the back facing by more than 5 mm, preferably by more than 2 mm. Still more preferably, the continuous profile member is absent back projecting continuous profile members. Preferably, the back facing is essentially flat, other than any profiled notches in a lower portion of the back facing which may serve to introduce a resilient quality in a portion that may largely unsupported.

Preferably, in one embodiment, a stair nosing as defined above comprises an elongate profile member that is sufficiently flexible to be affixed to a curved composite tread, such as a defining a curve of radius of at least 30 cm, more preferably at least 20 cm, still more preferably at least 10 cm, more preferably at least 5 cm.

The nosing of the present invention may be formed of any suitable material, such as a rigid plastic, a composite material or fibre-reinforced polymer, a metal or metal alloy, but is preferably a metal or metal alloy. Preferably, the nosing is aluminium or brass and most preferably brass.

A supplementary tread or covering may be installed on a stair tread, having a bull nose, according to another aspect of the invention, to form a composite tread by affixing the supplementary tread or covering on to the stair tread to define a composite tread front surface and affixing to the front surface of the composite tread a stair nosing as defined above by fixing a first fixing arrangement to a nose surface of a nose of the stair tread and an optional second fixing arrangement to the front surface of the composite tread at a position disposed toward the profile tread surface relative to the first fixing arrangement.

Preferably, the first fixing is fixed to the front of the bull nose by screwing screws into the bull nose via a series of apertures disposed in a recess in the front facing of elongate profile member of the nosing. Preferably, the optional second fixing is fixed to the front surface of the composite tread by applying an adhesive in a recess formed between the bull nose and the supplementary tread, and, where provided, inserting projection members disposed on the back facing of the elongate profile member into that recess and allowing the adhesive to cure. Typically, in this embodiment, the second fixing should be fixed before the first fixing.

Preferably, the supplementary tread comprises luxury vinyl tiles (LVT) or LVT on a plywood base (e.g. a 4 to 8 mm plywood base, preferably 6 mm base).

A result of the method is the production of a stair case, which is subject of a further aspect, the stair case comprising a plurality of composite stair treads separated by risers over which the composite stair treads overhang, the composite stair treads comprising an original stair tread having a nose (preferably a bull nose) and affixed thereon a supplementary tread extending from riser to nose to define a composite front surface with the nose and affixed to the composite front surface a stair nosing as defined above.

According to another aspect of the invention and preferred embodiment of the above-described aspects and embodiments of the invention, there is a stair nosing comprising an elongate profile member that is absent lateral axis stiffening profile sections. Preferably, it is absent any or all lateral axis stiffening profile sections. Lateral axis stiffening profile sections may be any profile section that significantly stiffens the elongate profile member about a lateral axis, which lateral axis is perpendicular to the direction of the longest dimension of the elongate profile member and preferably in or parallel to the plane of a back facing of the elongate profile member. A lateral axis stiffening profile section may be, for example, any section having a lateral element (i.e. extending along a width of the elongate profile member) and a transverse element (e.g. extending through the plane of a back facing of the elongate profile member) that extends to both sides of the elongate profile member defining the front and back facings (e.g. by at least 5 mm and preferably by at least 2 mm) or a transverse element that extends from backward from the back facing (e.g. by more than say 2 mm) or a transverse element that extends forward from the back facing by more than 10 mm. A lateral axis stiffening profile may be a curved profile about a longitudinal axis of the elongate profile member (e.g. of radius up to 20 mm, preferably up to 40 mm, preferably up to 50 m, more preferably up to 100 mm). A lateral axis stiffening profile section may be, for example, an upright or inverse U-section or an upright or inverse T-section disposed about a lateral axis or an I-section or an L-section wherein one leg (the first leg) of the L extends along a lateral dimension of the elongate profile member and the other leg of the L extends along a transverse dimension (forward or backward) and is at least 50% of the length of where the first leg. Preferably, within this context, the stair nosing may have any further features as defined for the first aspect above. Preferably, the elongate profile member has a back facing that is absent any back-projecting continuous profile member and more preferably is essentially flat.

The invention will now be described in more detail, without limitation, with reference to the accompanying Figures.

In FIG. 1, a stair nosing 1 is an elongate profile member 3 having a back facing 5, a front facing 7 (not visible) and a profile tread surface 9. A recess 11 is formed in the front facing 7 and defines a recessed facing 13. The recess 11 is bound by upper forward projection 15 and lower forward projection 17. A series of apertures 19 are drilled at 3" separations along the length of the elongate profile member 3 within the bounds of the recess 11 from the recessed facing 13 to the back facing 5 to enable the nosing 1 to be secured to a front surface of a bull nose of a stair tread (not shown). Stamped out from the elongate profile member 3, from the recessed facing are a series of arrow-shaped projecting members 21 projecting from the back facing 5 at an angle of about 40 degrees to the normal. The projecting members 21 are disposed closer to the profile tread surface 9 than the apertures 19 are. The projecting members 21 are separated by 3" spaces and vertically offset from the apertures 19. The projecting members 21 are configured to extend into a recess 39 (shown in FIG. 2) formed between a bull nose 27 and a supplementary tread 29 where it can be secured by an adhesive.

Figure 2:
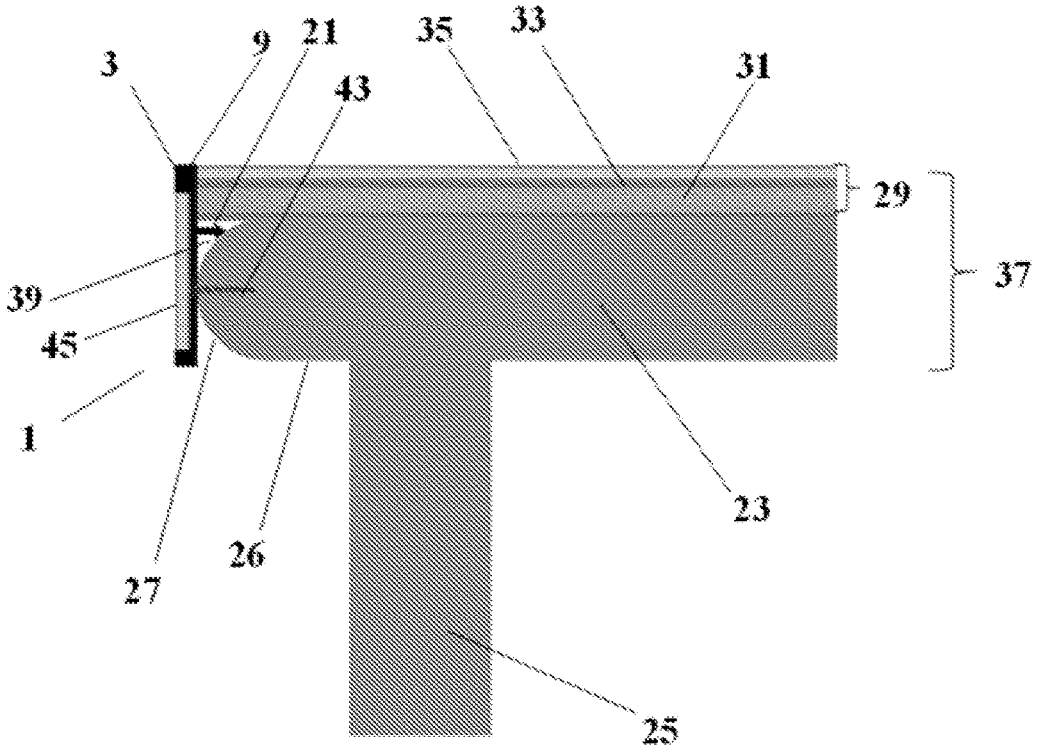
FIG. 2 is a cross sectional view of a nosing according to one embodiment of the present invention installed on a composite tread of a modified staircase.

FIG. 2 shows a cross-section of a composite tread 37 of a modified stair in which a nosing 1 of the invention is installed. The stair comprises a stair tread 23 and a riser 25 beneath the stair tread 23 defining an overhang 26. The stair tread 23 has a bull nose 27. A supplementary tread 29 is fixed to the upper surface of the stair tread to provide a composite tread 37. The front surface of the composite tread 37 is defined by the front surface of the bull nose 27 and the front surface of the supplementary tread 29 which define therebetween a recess 39. The supplementary tread 29 typically comprises a ply base 31 fixed to the upper surface of the stair tread 23 then a layer of underlay 33 and a luxury vinyl tile (LVT) 35.

A nosing 1, which is made of aluminium, is fixed to the front surface of the composite tread 37 by first applying adhesive (not shown) into recess 39 in the front surface of the composite tread and then placing the back facing 5 of elongate profile member 3 against the front surface of the composite tread so that the profile tread surface 9 is aligned with the supplementary tread 29 (or projects slightly above it) and such that the projecting members 21 extend into the recess 39. Screws 43 may then be screwed into the front surface of the bull nose 27 via apertures 19 so that the nosing 1 can be fixed securely in place without the need to square off the bull nose. A strip of the LVT can be provided as a decorative inset element 45 in the recess 11 of the front facing 7 of the elongate profile member 3.

Figure 3A:
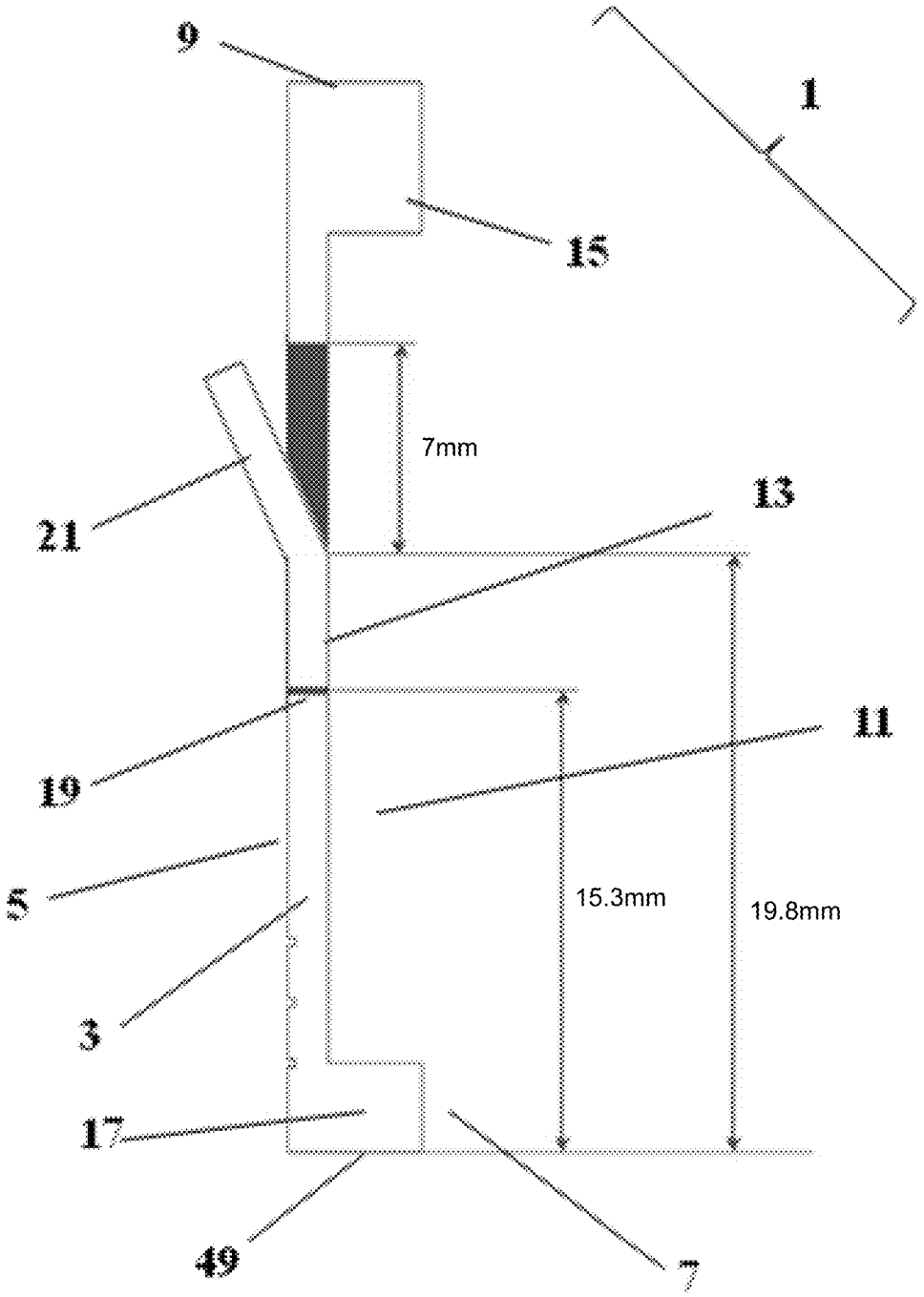
FIGS. 3A, 3B and 3C are sectional views of stair nosing profiles of FIG. 1 according to three preferred embodiments.
Figure 3B:
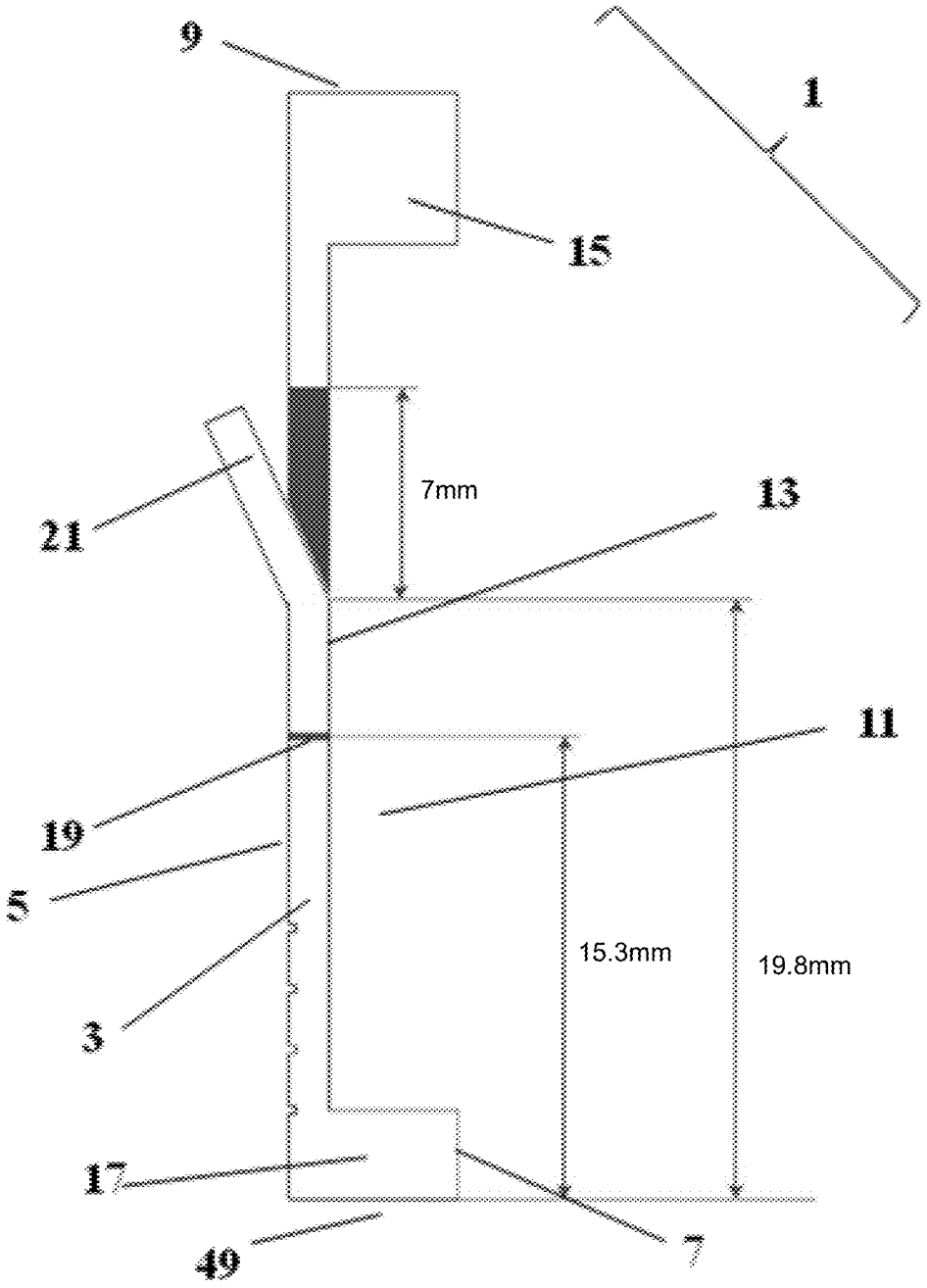
Figure 3C:
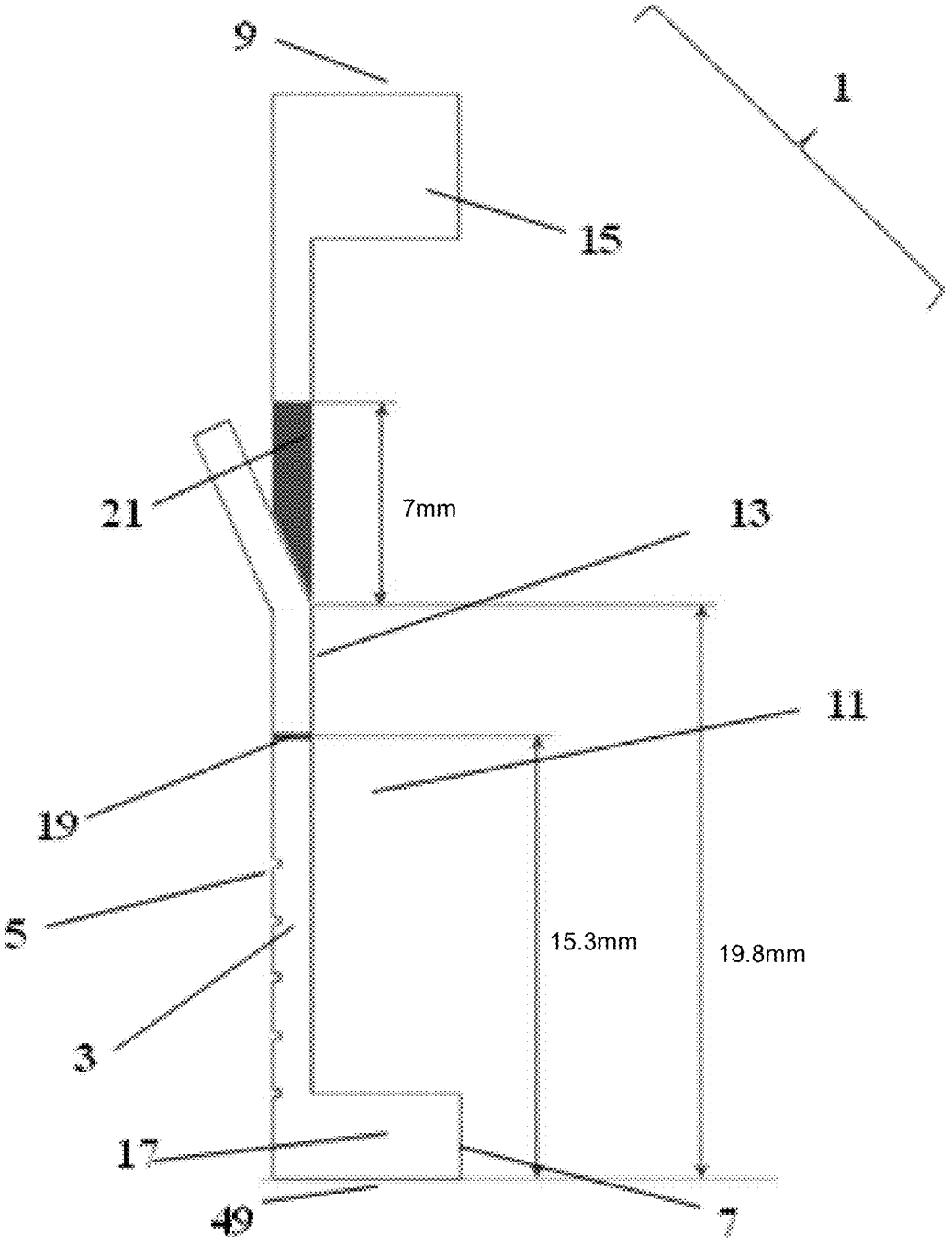

FIGS. 3A, 3B and 3C are adapted cross-sectional profile views of three preferred embodiments of the stair nosing 1 of the invention. In FIG. 3A, elongate profile member 3 is shown to have a back facing 5, front facing 7 and profile tread surface 9. Upper front projection 15 and lower front projection 17 define a recess 11 in the front facing 7 which defines a recessed facing 13. Stamped projecting member 21 having a length of 7 mm is shown projecting from back facing 5 by a distance of about 5 mm and at an angle of about 60 degrees to the normal. A correspondingly shaped stamped aperture 47 is formed in the elongate profile member 3 extending from the recessed facing 13 to the back facing 5. The position of aperture 19 is illustrated as being 15.3 mm from the lower surface 49 whilst the projecting members 21 extend from a position 19.8 mm from the lower surface 49 (and so separated from the aperture 19 by 4.5 mm). The recess 11 has a depth of 3.1 mm so as to accommodate a 3 mm LVT inset element adhered to the recessed facing 13 allowing the LVT surface to be flush with front facing 7. FIG. 3B is identical except that the recess 11 has a depth of 4.1 mm to accommodate a 4 mm LVT and FIG. 3C is also identical except that the recess 11 has a depth of 5.1 mm to accommodate a 5 mm LVT.

Figure 4:
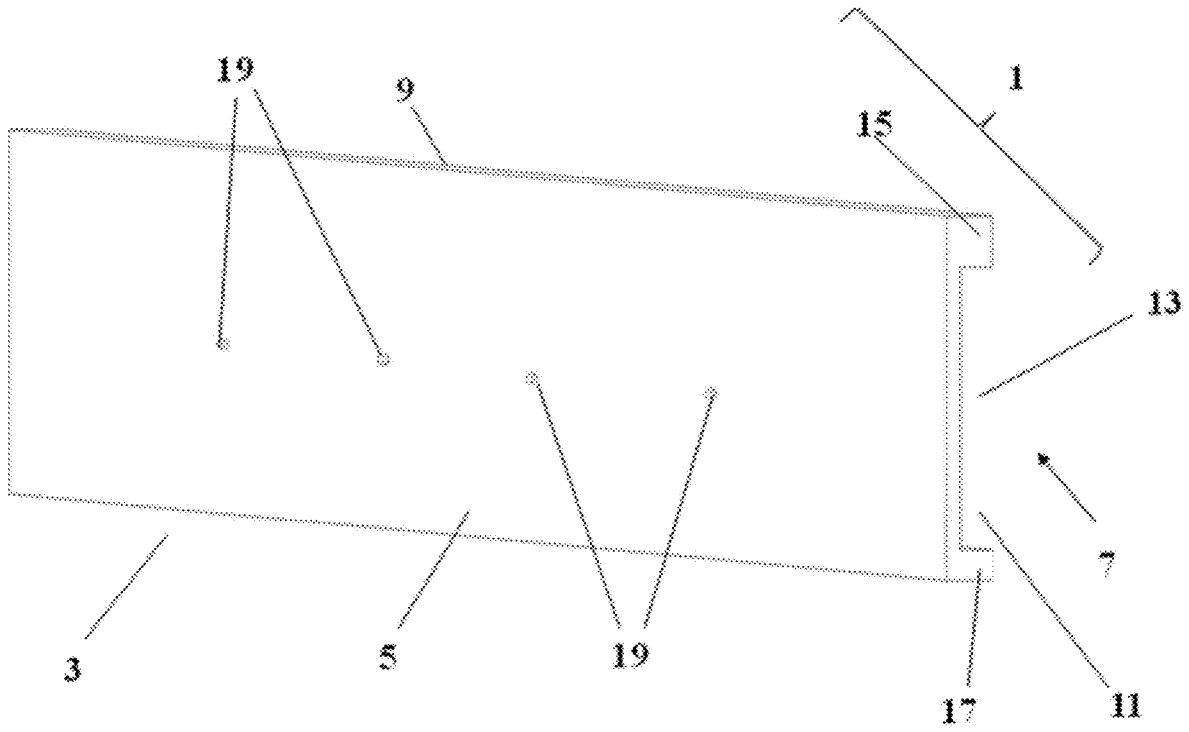
FIG. 4 is a perspective view of a stair nosing according to another embodiment of the present invention.

In FIG. 4, a stair nosing 1 is an elongate profile member 3 having a back facing 5, a front facing 7 (not visible) and a profile tread surface 9. A recess 11 is formed in the front facing 7 and defines a recessed facing 13. The recess 11 is bound by upper forward projection 15 and lower forward projection 17. A series of apertures 19 are drilled at 3" separations along the length of the elongate profile member 3 within the bounds of the recess 11 from the recessed facing 13 to the back facing 5 to enable the nosing 1 to be secured to a front surface of a bull nose of a stair tread (not shown). The stair nosing of this embodiment does not have projecting members projecting from the back face. The elongate profile member 3 is preferably brass. The transverse width of the elongate profile member 3 is preferably 20 to 50 mm. The transverse width of the profile tread surface 9 is preferably 3 to 11 mm, more preferably up to 8 mm. The recess 7 may have a depth of from 3 to 7 mm and a width of 15 to 40 mm. In use during fitting, a glue or adhesive resin may typically (and optionally) be applied to the nose of the stair tread or to the front surface of the composite stair tread and/or in the recess defined between a bull-nose and the supplementary tread. The elongate profile member 3 may be placed against the composite stair tread and affixed thereto by way of screws into the front face of a nose of the stair tread via apertures 19. With or without adhesive resin, the elongate profile member 3. This provides a robust and rigid arrangement. A fixing point (via the apertures 19) and a second contact point where the elongate profile member 3 abuts a front surface of the supplementary tread, provide two contact points which make for a rigid arrangement in situ. When applied to a curved step, the nosing 1 provides a still more rigid and robust stair nosing since further rigidity is provided by way of the curvature.

Figure 5:
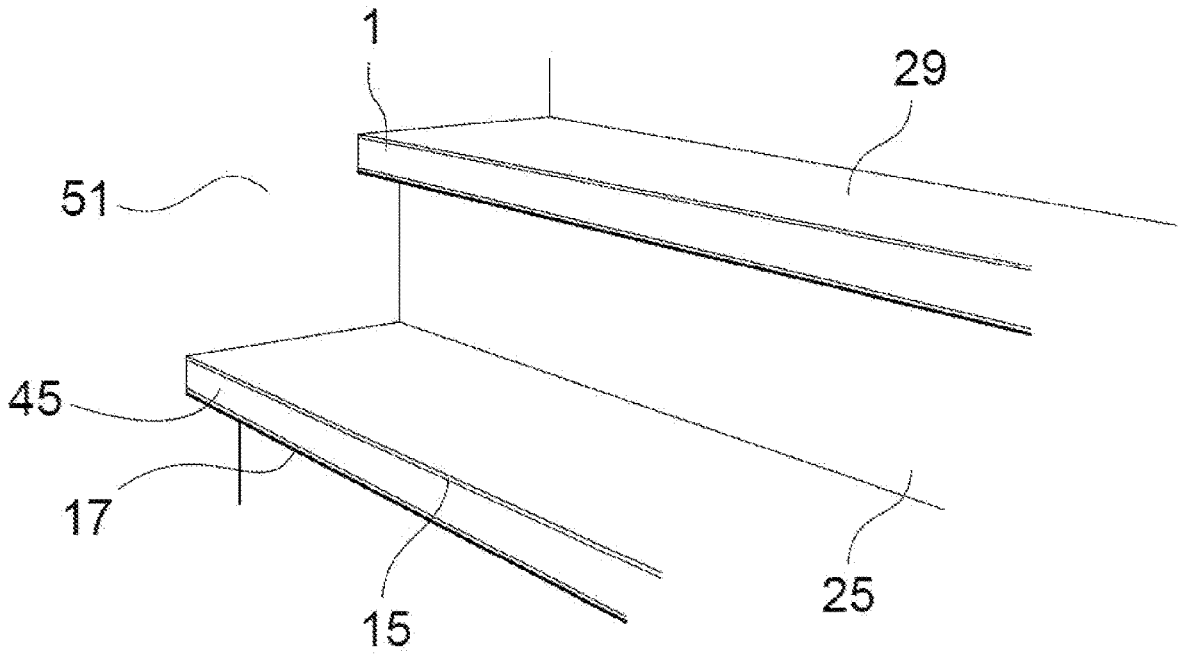
FIG. 5 is an illustrative representation of a modified staircase of another aspect of the invention modified with a stair nosing of a first aspect of the present invention according to the embodiment of FIG. 1.

FIG. 5 shows a perspective view of an illustrative representation of a modified stair 51 according to an aspect of the invention comprising a nosing of the invention as described in relation to FIG. 1, for example. The modified stair comprises a riser 25 and stair tread (not shown) arrangement and disposed on the stair tread a supplementary tread 29. Nosing 1 is fitted to a front surface of a composite tread (not shown) comprising the supplementary tread 29 on the stair tread (not shown). The upper forward projecting member 15 (defining the profile tread surface 9) and lower projecting member 17 of aluminium or brass are visible and separated by a decorative LVT inset element 45.

Figure 6:
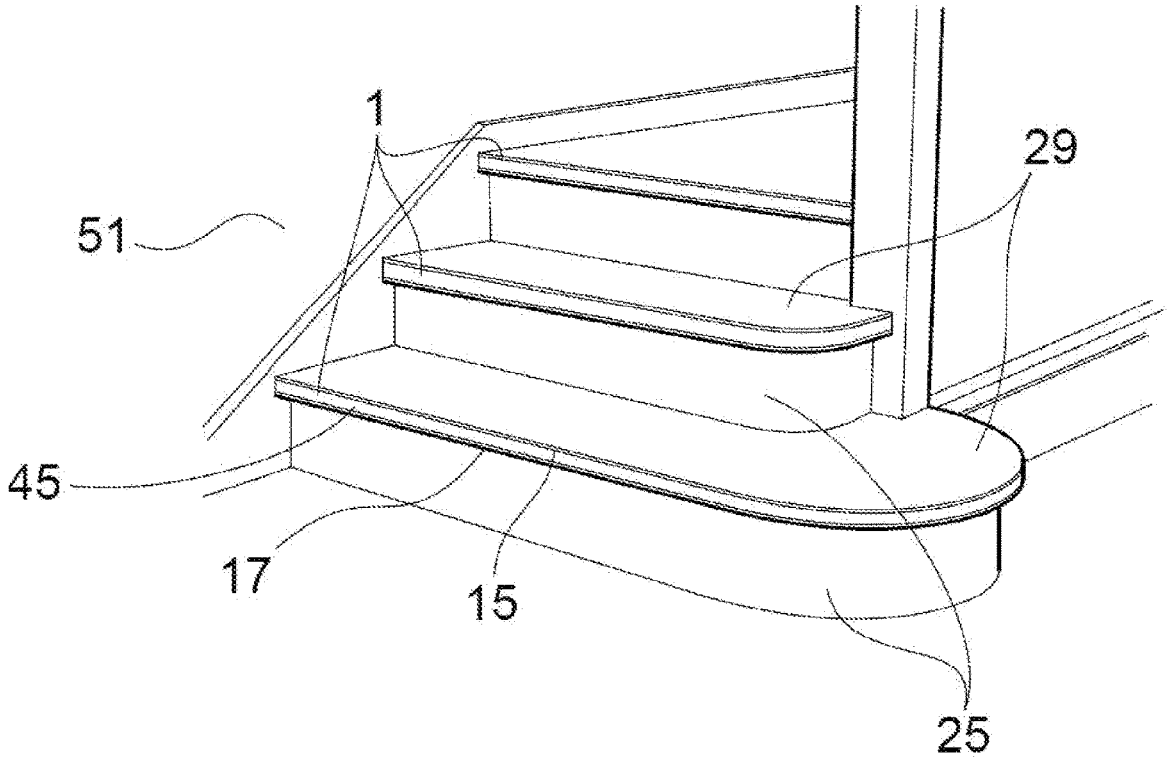
FIG. 6 shows a modified staircase of an aspect of the invention modified with a stair nosing of the invention and the embodiment of FIG. 4.

FIG. 6 shows a perspective view of a modified stair 51 according to according to an aspect of the invention comprising a nosing of the invention as described in relation to FIG. 4. The modified stair comprises a riser 25 and stair tread (not shown) arrangement and disposed on the stair tread a supplementary tread 29. Nosing 1 is fitted to a front surface of a composite tread (not shown) comprising the supplementary tread 29 on the stair tread (not shown). The upper forward projecting member 15 (defining the profile tread surface 9) and lower projecting member 17 of brass are visible and separated by a decorative LVT inset element 45. The upper step is straight and the lower two steps show curves. The elongate profile member of FIG. 4 is effective in bending around a curve up to about 180° and with a radius of curvature of about 15-20 cm as can be seen from the lower step in the Figure.

The invention has been described with reference to a preferred embodiment. However, it will be appreciated that variations and modifications can be effected by a person of ordinary skill in the art without departing from the scope of the invention.

What is claimed is:

1. A stair nosing comprising an elongate profile member having a back facing configured for abutting a nose of a stair tread, a front facing generally opposed to the back facing and a profile tread surface, which elongate profile member comprises a first fixing arrangement for facilitating fixing to a nose surface of the nose of the stair tread, wherein the elongate profile member is sufficiently flexible to bend from a straight orientation about a lateral axis to define a curve having a radius of curvature from 5 to 20 cm to be affixed to a curved tread or composite tread, wherein the lateral axis is in a plane or parallel to a plane of the back facing and is perpendicular to a longitudinal axis in the elongate direction of the elongate profile member, wherein the elongate profile member is absent a lateral axis stiffening profile section comprising a transverse element extending forward by at least 10 mm from a plane of the back facing, wherein the stair nosing comprises a recess formed in the front facing, extending along the length of the elongate profile member and configured to receive a strip insert of material, wherein the recess defines an upper forward projection and a lower forward projection projecting forward from and flush with the back facing, and wherein the back facing is planar when the elongate profile member is in a straight configuration.

2. The stair nosing according to claim 1, wherein the elongate profile member is formed of brass.

3. The stair nosing according to claim 1, wherein the first fixing arrangement comprises a series of apertures disposed at separations along the length of the elongate profile member each extending from the front facing to the back facing to receive a screw or nail for securing to a nose.

4. The stair nosing according to claim 1, wherein the recess defines a recessed facing.

5. The stair nosing according to claim 4, wherein the upper and lower forward projections distinguish the front facing with the recessed facing.

6. The stair nosing according to claim 5, wherein the upper and lower forward projections have a forward extent of from 2 to 8 mm from the recessed facing.

7. The stair nosing according to claim 4, wherein the profile has a thickness between the back facing and the recess facing in the range of from 1 to 3 mm.

8. The stair nosing according to claim 1, wherein the strip insert of material corresponds to a supplementary tread or covering.

9. The stair nosing according to claim 1, wherein the recess has a depth of from 2 to 8 mm.

10. The stair nosing according to claim 1, wherein the upper forward projection has a thickness of 3 to 10 mm.

11. The stair nosing according to claim 1, wherein the lower forward projection has a thickness of 2 to 10 mm.

12. The stair nosing according to claim 1, wherein the recess has a width of from 15 to 70 mm.

13. The stair nosing according to claim 1, wherein the elongate profile member has a maximum thickness of from 3 to 11 mm.

14. The stair nosing according to claim 1, wherein the elongate profile member has a width of up to 75 mm.

15. The stair nosing according to claim 1, wherein the supplementary tread comprises LVT or LVT on a plywood base.

16. A method of installing a supplementary tread or covering on a stair tread having a bull nose to form a composite tread, the method comprising affixing the supplementary tread or covering on to the stair tread to define a composite tread front surface and affixing to the front surface of the composite tread a stair nosing as defined in claim 1 by fixing a first fixing arrangement to a nose surface of a nose of the stair tread.

* * * * *